US010551762B2

(12) United States Patent
Kohno

(10) Patent No.: US 10,551,762 B2
(45) Date of Patent: Feb. 4, 2020

(54) IMAGE FORMING APPARATUS HAVING GUIDING MEMBER FOR REGULATING APPROACH OF RECORDING MATERIAL TOWARD TRANSFER BELT

(71) Applicant: CANON KABUSHIKI KAISHA, Tokyo (JP)

(72) Inventor: Tatsuya Kohno, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/175,881

(22) Filed: Oct. 31, 2018

(65) Prior Publication Data

US 2019/0129323 A1 May 2, 2019

(30) Foreign Application Priority Data

Nov. 1, 2017 (JP) ..... 2017-212278

(51) Int. Cl.
*G03G 15/01* (2006.01)
*G03G 15/16* (2006.01)
*G03G 15/08* (2006.01)

(52) U.S. Cl.
CPC ..... *G03G 15/0189* (2013.01); *G03G 15/0808* (2013.01); *G03G 15/0815* (2013.01); *G03G 15/1605* (2013.01); *G03G 2215/1623* (2013.01); *G03G 2215/1661* (2013.01)

(58) Field of Classification Search
CPC ..... G03G 15/0189; G03G 15/1605; G03G 15/1615; G03G 15/6558
USPC ..... 399/121, 302
See application file for complete search history.

(56) References Cited

U.S. PATENT DOCUMENTS

| | | | | |
|---|---|---|---|---|
| 6,697,595 | B2 | 2/2004 | Kawagoe et al. | |
| 8,515,311 | B2 * | 8/2013 | Kishi | G03G 15/1605 399/121 |
| 9,026,018 | B2 * | 5/2015 | Miyoshi et al. | G03G 15/1605 399/302 |
| 9,229,374 | B2 | 1/2016 | Kakehi | |
| 9,772,584 | B2 | 9/2017 | Aiba | |
| 9,804,535 | B2 | 10/2017 | Kakehi | |
| 2017/0329262 | A1 | 11/2017 | Aiba | |

FOREIGN PATENT DOCUMENTS

| | | | |
|---|---|---|---|
| JP | 2002-082543 | A | 3/2002 |
| JP | 2010-134167 | A | 6/2010 |
| JP | 2011-033826 | A | 2/2011 |

(Continued)

*Primary Examiner* — William J Royer
(74) *Attorney, Agent, or Firm* — Venable LLP

(57) ABSTRACT

An image forming apparatus includes an endless belt, an inner roller, an upstream roller, a pressing member, and a guiding member. In a cross-section perpendicular to a rotational axis of the inner roller, a downstream free end of the guiding member is disposed downstream of a pressing portion normal line Lc with respect to a feeding direction of the sheet, where L is a reference line which is a common tangent of the inner roller and the upstream roller in a contact portion relative to the belt, Ld is a pressing portion tangent line, parallel with the reference line, of the belt in a region where the pressing member contacts the belt, and Lc is the pressing portion normal line passing through a contact point between the belt and the pressing portion tangent line Ld and perpendicular to the reference line L.

10 Claims, 4 Drawing Sheets

(56) References Cited

FOREIGN PATENT DOCUMENTS

| | | | |
|---|---|---|---|
| JP | 2015-215594 | A | 12/2015 |
| JP | 2017-009767 | A | 1/2017 |
| JP | 2017-045016 | A | 3/2017 |

* cited by examiner

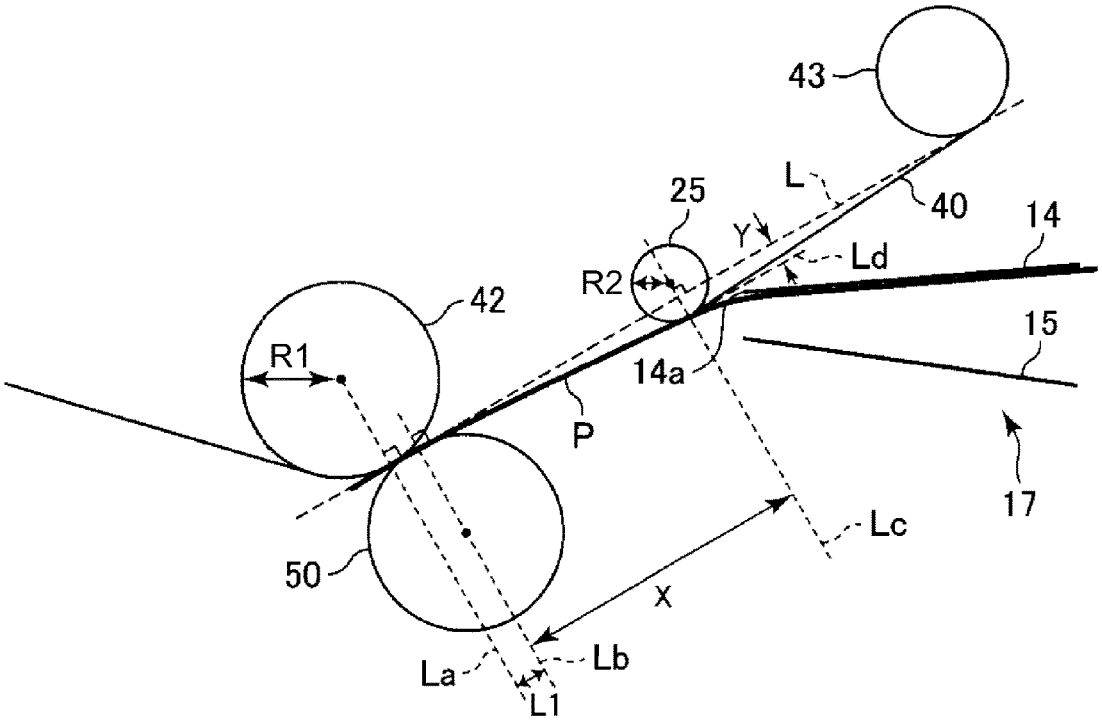
Fig. 4
CONVENTIONAL

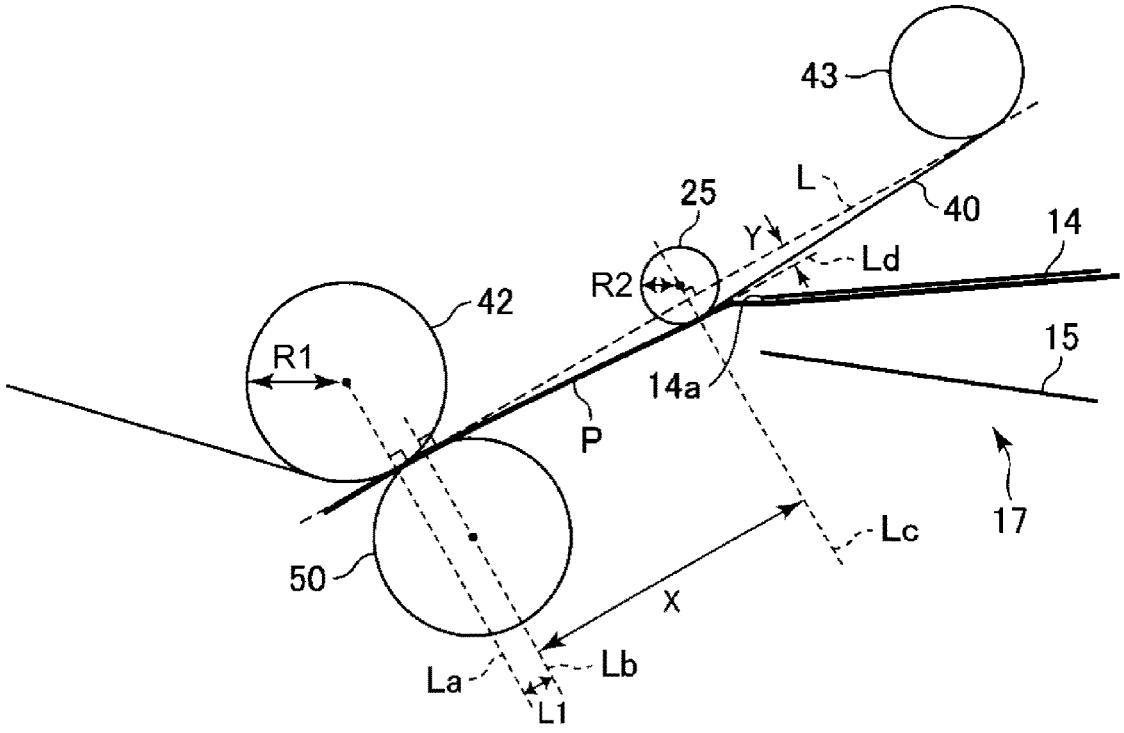
Fig. 6
CONVENTIONAL

IMAGE FORMING APPARATUS HAVING GUIDING MEMBER FOR REGULATING APPROACH OF RECORDING MATERIAL TOWARD TRANSFER BELT

FIELD OF THE INVENTION AND RELATED ART

The present invention relates to an image forming apparatus, such as a copying machine, a printing machine, and a facsimile machine, which uses an electrophotographic image forming method, an electrostatic image recording method, or the like.

Some image forming apparatuses which use an electrophotographic image forming method, an electrostatic image recording method, or the like employ an endless belt as an image bearing member, which bears and conveys a toner image. An endless belt as an image bearing member is suspended and tensioned by two or more belt suspension-tension rollers. There are various image bearing members which are in the form of an endless belt. For example, there are: an electrophotographic photosensitive belt (electrophotographic photosensitive member which is in the form of an endless belt); a dielectric member such as one in the form of an endless belt, and on which an image is electrostatically recorded; an intermediary transfer member (intermediary transfer belt) onto which a toner image is transferred from a photosensitive member; or the like. There are also various methods for transferring a toner image from an image bearing endless belt onto a sheet of recording medium such as paper. One of such methods uses a roller (transfer roller) which is to be placed in contact with the outward surface of an endless belt to form a transferring portion, in order to form an electric field (transfer electric field) to transfer a toner image onto a sheet of recording medium as the sheet is conveyed through the transferring portion.

To describe further an endless belt as an image belt member, with reference to an image forming apparatus of the so-called intermediary transfer type, an image forming apparatus of the intermediary transfer type has an intermediary transfer belt as an image bearing member in the form of an endless belt. It has also two or more belt suspension-tension rollers, such as an inward secondary transfer roller and an outward secondary transfer roller, which are positioned on the inward side of a loop (belt loop) which the image bearing member (endless belt) forms. The outward secondary transfer roller is positioned in contact with the outward surface of the intermediary transfer belt in a manner to oppose the inward secondary transfer roller, with the presence of the intermediary transfer belt between the two rollers. As secondary transfer bias which is opposite in polarity from toner is applied to the outward secondary transfer roller (or inward secondary transfer roller), a toner image is transferred from the intermediary transfer belt onto a sheet of recording medium as the sheet is conveyed through the secondary transferring portion.

In the case of an image forming apparatus such as the one described above, it sometimes occurs that as the intermediary transfer belt is rotationally driven, it vibrates and/or undulates in the adjacencies of the secondary transferring portion, and/or that, if the intermediary transfer belt is not stable in attitude, the intermediary transfer belt and a sheet of recording medium fail to remain in contact with each other (gap is created between belt and sheet). Thus, it sometimes occurs that a sheet of recording medium fails to remain airtightly in contact with the intermediary transfer belt. If a sheet of recording medium fails to remain in contact with the intermediary transfer belt, with the presence of no gap between the sheet and intermediary transfer belt, it sometimes occurs that electrical discharge occurs between the sheet and intermediary transfer belt, in the adjacencies of the secondary transferring portion. This electrical discharge sometimes disturbs the toner image on the intermediary transfer belt, in toner charge distribution. If the toner image on the intermediary transfer belt is disturbed in toner charge distribution, the toner image increases in the amount of toner particles which do not respond to the electrostatic force which is generated in the secondary transferring portion. If the toner image increases in the amount of toner particles which do not respond to the electrostatic force in the secondary transferring portion, the toner image fails to be properly transferred onto a sheet of recording medium.

There have been made various proposals to deal with this problem. According to one of them, an image forming apparatus is provided with a vibration prevention member which is positioned in the adjacencies of the secondary transferring portion to keep the intermediary transfer belt stable in attitude (Japanese Laid-open Patent Application No. 2010-134167, Japanese Laid-open Patent Application No. 2002-082543). With the image forming apparatus being structured as described above, the intermediary transfer belt remains pressed outward from the inward side of the loop the belt forms, on the upstream side of the second transferring portion in terms of the rotational direction of the intermediary transfer belt (direction in which surfaces of the intermediary transfer belt move). Thus, it is prevented that the intermediary transfer belt vibrates and/or undulates on the upstream side of the secondary transferring portion in terms of the rotational direction of the intermediary transfer belt. Therefore, it is prevented that electrical discharge occurs between a sheet of recording medium and the intermediary transfer belt, on the upstream side of the secondary transferring portion in terms of the rotational direction of the intermediary transfer belt. Therefore, it is prevented that an image forming apparatus is reduced in image transfer performance by the vibration and/or undulation of the intermediary transfer belt described above.

However, if the intermediary transfer belt is pressed outward by the vibration prevention member from the inward side of the aforementioned belt loop, the portion of the intermediary transfer belt, which is in contact with the intermediary transfer belt, is displaced outward. As the intermediary transfer belt is outwardly displaced by a substantial amount, the area of contact between a sheet of recording medium (which is being guided to the secondary transferring portion by conveyance guides) and the intermediary transfer belt increases in dimension in terms of the recording medium conveyance direction. In a case where a sheet of recording medium such as cardstock or coated paper, which are higher in rigidity, and therefore, are resistant to bending, is conveyed in an image forming apparatus structured as described above, the sheet and intermediary transfer belt sometimes rub against each other in the area in which the vibration prevention member and the sheet are in contact with each other. If it is on the upstream side of the secondary transferring portion, in terms of the rotational direction of the intermediary transfer belt, that the sheet and intermediary transfer belt rub against each other, the unfixed toner image borne on the intermediary transfer belt is disturbed. Consequently, the disturbed toner image is transferred onto the sheet of recording medium. That is, an unsatisfactory image is formed on the sheet.

SUMMARY OF THE INVENTION

Thus, the primary object of the present invention is to provide an image forming apparatus which is structured to press the inward surface of its belt to improve the apparatus in transfer performance, and yet, can prevent the occurrence of the image defect attributable to the rubbing which occurs between a sheet of recording medium and the belt, in the area in which the belt is pressed.

The object described above can be accomplished by an image forming apparatus.

According to an aspect of the present invention, there is provided an image forming apparatus comprising an image bearing member configured to bear a toner image; an endless belt provided opposed to said image bearing member and configured to receive the toner image from said image bearing member at a primary transfer portion; an outer roller contacted to an outer peripheral surface of said belt and configured to transfer the toner image from said belt onto a recording material at a secondary transfer portion; a plurality of stretching rollers configured to support said belt, said stretching rollers including an inner roller provided opposed to said outer roller with said belt interposed therebetween and cooperative with said outer roller to provide the secondary transfer portion, and an upstream roller provided downstream of the primary transfer portion and upstream of said inner roller, with respect to a moving direction of said belt; a pressing member provided at a position upstream of said inner roller and downstream of said upstream roller with respect to the moving direction and configured to press said belt in a direction from an inside toward an outside of said belt, said pressing member pressing said belt in a range of 25 mm from a portion where said inner roller contacts said belt toward an upstream side with respect to the moving direction; a feeding device configured to feed the recording material to the secondary transfer portion; and a guiding member provided downstream of said feeding device and upstream of said secondary transfer portion with respect to a feeding direction of the recording material and configured to regulate movement of the recording material approaching said belt, wherein in a cross-section perpendicular to a rotational axis of said inner roller, a downstream free end of said guiding member is disposed downstream of a pressing portion normal line Lc with respect to the feeding direction of the recording material, where L is a reference line which is a common tangent of said inner roller and said upstream roller in a contact portion relative to said belt, Ld is a pressing portion tangent line, parallel with the reference line, of said belt in a region where said pressing member contacts said belt, and Lc is the pressing portion normal line passing through a contact point between said belt and the pressing portion tangent line Ld and perpendicular to the reference line L.

Further features of the present invention will become apparent from the following description of exemplary embodiments with reference to the attached drawings.

BRIEF DESCRIPTION OF THE DRAWINGS

FIG. 4 is a schematic vertical sectional view of the secondary transferring portion and its adjacencies of a comparative (conventional) image forming apparatus, and shows the recording medium conveyance passage of the apparatus.

FIG. 6 is a schematic vertical sectional view of the secondary transferring portion and its adjacencies of a comparative (conventional) image forming apparatus, and shows the recording medium conveyance passage of the apparatus.

DESCRIPTION OF THE EMBODIMENTS

Hereinafter, image forming apparatuses which are in accordance with the present invention are described in detail with reference to appended drawings.

[Embodiment 1]

1. Overall Structure and Operation of Image Forming Apparatus

Figure 1:
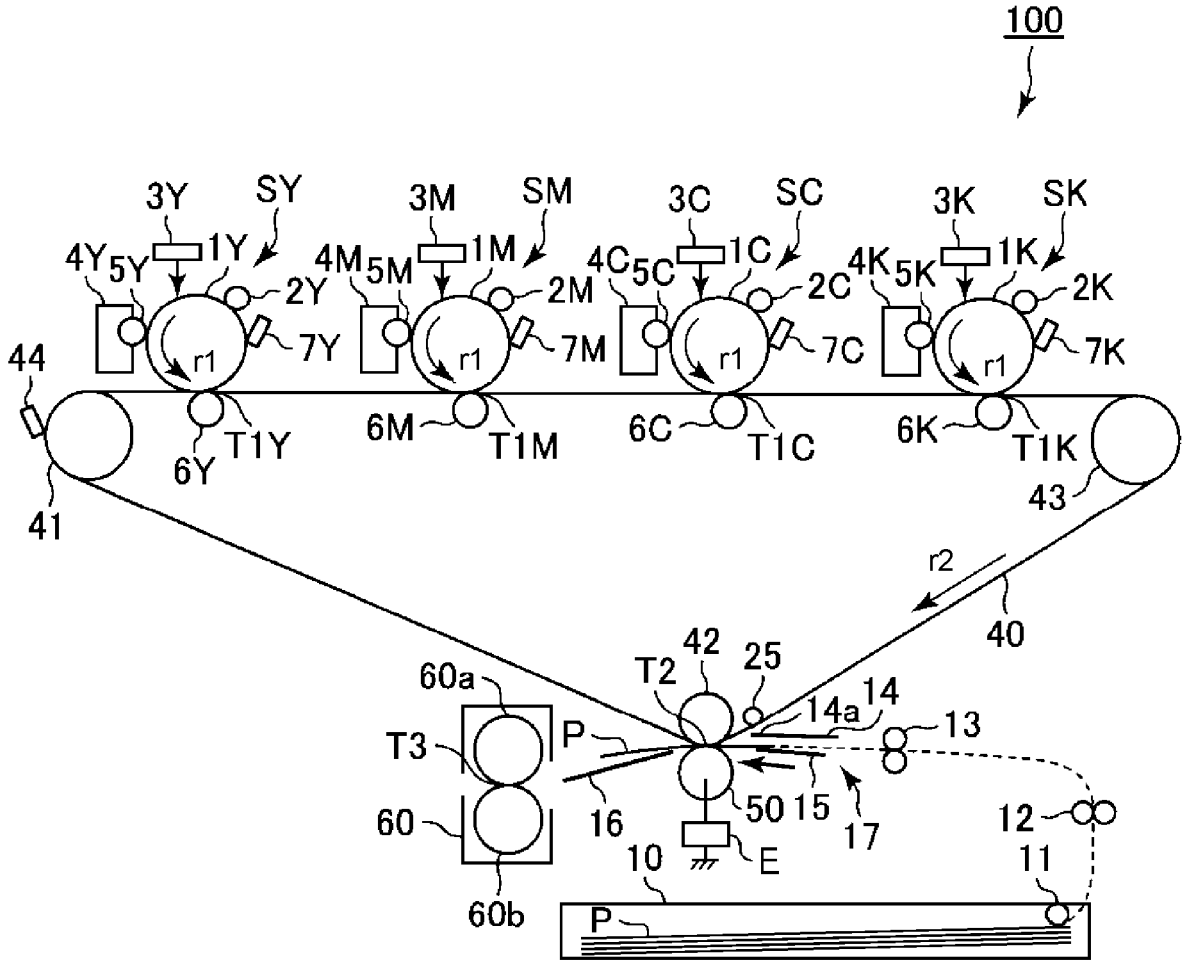
FIG. 1 is a schematic vertical sectional view of the image forming apparatus in the first embodiment of the present invention.

FIG. 1 is a schematic vertical sectional view of the image forming apparatus 100 in this embodiment of the present invention. The image forming apparatus 100 can form a full-color image with the use of an electrophotographic image forming method. It is of the so-called intermediary transfer type, and also, of the so-called tandem type.

The image forming apparatus 100 has multiple image forming portions (stations), more specifically, the first, second, third and fourth image forming portions SY, SM, SC and SK, which form yellow (Y), magenta (M), cyan (C) and black (K) toner images, respectively. The four image forming portions SY, SM, SC and SK are practically the same in structure and function, although they are different in the color of the toner image they form. Thus, the suffixes Y, M, C and K, which indicate the color of the image they form, may be sometimes omitted to describe the four image forming portions together. In this embodiment, each image forming portion S is made up of a photosensitive drum 1, a charge roller 2, an exposing apparatus 3, a developing apparatus 4, a primary transfer roller 6, a drum cleaning apparatus 7, etc.

The image forming portion S has the photosensitive drum 1, which is an electrophotographic photosensitive member in the form of a drum. It is an image bearing member (image bearing first member) which bears a toner image. The photosensitive drum 1 is rotationally driven in the direction (counterclockwise direction) indicated by an arrow r1 in FIG. 1. It is made up of an electrically conductive and cylindrical substrative member, and a photosensitive layer which covers the entirety of the peripheral surface of the substrative member. In this embodiment, the photosensitive drum 1 is rotationally driven at a peripheral velocity (process speed) of 350 mm/sec, for example. As the photosensitive drum 1 is rotated, its peripheral surface is uniformly charged to a preset polarity (negative in this embodiment) and a preset potential level by the charge roller 2, as a charging member, which is a charging member in the form of a roller. The charge roller 2 is positioned in contact with the photosensitive drum 1. During the charging process, a preset charge voltage (charge bias) is applied to the charge roller 2. In this embodiment, the peripheral surface of the photosensitive drum 1 is charged to −400 V (pre-exposure potential level), for example, by the charge roller 2. The uniformly charged portion of the photosensitive drum 1 is scanned by the beam of laser light emitted by the exposing apparatus 3, as an exposing means, while being modulated according to the information of the image to be formed. Consequently, an electrostatic image (electrostatic latent image) is formed on the peripheral surface of the photosensitive drum 1. The exposing apparatus 3 separates an image to be formed, into four monochromatic images, which correspond to the four image forming stations S, one for one, to create the data of the image to be formed, in order to write an electrostatic image on the uniformly charged portion of the peripheral surface of the photosensitive drum 1 by scanning the uniformly charged portion of the peripheral surface of the photosensitive drum 1 with the beam of laser light it emits while modulating (turning On or Off) the beam, in accordance with the image data, with use of its rotational mirror. An electrostatic latent image written on the photosensitive drum 1 is made up of a collection of minute dots. Therefore, a toner image to be formed on the peripheral surface of the photosensitive drum 1 can be changed in density by changing in density this collection of dots to be formed on the peripheral surface of the photosensitive drum 1.

The electrostatic image formed on the photosensitive drum 1 is developed (turned into visible image) by the developing apparatus 4, as a developing means, which uses developer. Consequently, a toner image is formed on the photosensitive drum 1. In this embodiment, after the peripheral surface of the photosensitive drum 1 is uniformly charged, it is exposed. As a given point of the uniformly charged portion of the photosensitive drum 1 is exposed, it reduces in the absolute value. It is these points reduced in absolute value that toner charged to the same polarity as that of the uniformly charged portion of the peripheral surface of the photosensitive drum 1 is adhered. More concretely, as the given point is exposed, it reduces in potential level. It is this point, or exposed point, that toner adheres (image portion exposure; reversal development). In this embodiment, the developing apparatus 4 uses two-component developer, which is a mixture of toner (nonmagnetic toner particles) and carrier (magnetic carrier particles). The developing apparatus 4 has a development sleeve 5, as a developer bearing member, which is positioned so that a minute gap is provided between the peripheral surface of the photosensitive drum 1 and that of the development sleeve 5. In this embodiment, the development sleeve 5 is rotationally driven in such a direction that, in the area in which the small gap is present between the peripheral surface of the photosensitive drum 1 and that of the development sleeve 5, the peripheral surface of the development sleeve 5 moves in the opposite (counter) direction from the direction in which the peripheral surface of the photosensitive drum 1 moves. The developing apparatus 4 charges the two-component developer, or the mixture of toner and carrier, makes the development sleeve 5 bear the charged developer, and conveys the charged developer to the area in which the distance between the peripheral surface of the photosensitive drum 1 and that of the development sleeve 5 is smallest, and in which development voltage (development bias), the DC component of which is −300 V, for example, is applied to the development sleeve 5. Thus, the negatively charged toner moves to the exposed points of the peripheral surface of the photosensitive drum 1, which have become positive in polarity relative to the toner. That is, the electrostatic latent image is developed. In this embodiment, the toner polarity during a development process, that is, the polarity of the normally charged toner, is negative.

The image forming apparatus 100 is provided with an intermediary transfer belt 40, which is an image bearing member (image bearing second member), which is for bearing a toner image. It is an endless belt, and is positioned below (downward side in FIG. 1) a combination of the photosensitive drums 1Y, 1M, 1C and 1K. The intermediary transfer belt 40 is supported and tensioned by a combination of multiple suspension-tension (supporting) rollers, as a suspending-tensioning means, more specifically, a tension roller 41, an inward secondary transfer roller 42, and a driving roller 43. In this embodiment, by the way, the image forming apparatus 100 is provided with a pressure roller 25, as a pressing member, which is positioned on the inward side of the loop (belt loop) which the intermediary transfer belt 40 forms. This setup will be described later in detail. The pressure roller 25 is not a part of the combination of suspension-tension rollers. As the driving roller 43 is rotationally driven, the intermediary transfer belt 40 rotationally moves (circularly moves) in the direction (clockwise direction) indicated by an arrow r1 in the drawing, at a preset peripheral velocity (process speed), which is roughly the same as the peripheral velocity of the photosensitive drum 1. The image forming apparatus 100 is also provided with the primary transfer roller 6, which is the primary transferring member as the primary transferring means in the form of a roller. The primary transfer roller 6 is positioned on the inward side of the loop the intermediary transfer belt 40 forms. Further, the image forming apparatus 100 is structured so that the primary transfer roller 6 presses the intermediary transfer belt 40 outward from the inward side of the belt loop (toward photosensitive drum 1), forming thereby the primary transferring portion T1 (primary transfer nip), or the area of contact (interface) between the photosensitive drum 1 and intermediary transfer belt 40. The toner image formed on the photosensitive drum 1 as described above is transferred (primary transfer) onto the rotating intermediary transfer belt 40, by the function of the primary transfer roller 6, in the primary transferring portion T1. During the primary transfer, the primary transfer voltage (primary transfer bias), which is a DC voltage, is applied to the primary transfer roller 6. The primary transfer voltage is opposite in polarity from the normal toner charge. For example, in an image forming operation for forming a full-color image, the yellow, magenta, cyan, and black toner images are formed on the four photosensitive drums 1, one for one, and are sequentially transferred onto the intermediary transfer belt 40 in a manner to be layered upon the intermediary transfer belt 40.

On the outward surface side of the intermediary transfer belt 40, an outward secondary transfer roller 50, as the secondary transferring member, is positioned in a manner to oppose the inward secondary transfer roller 42. The outward secondary transfer roller 50 is a secondary transferring member in the form of a roller. The intermediary transfer belt 40 is pressed inward of the belt loop by the outward secondary transfer roller 50 from the outward side of the belt loop. Thus, a secondary transferring portion T2 (secondary transfer nip) is formed, which is the area of contact (interface) between the intermediary transfer belt 40 and outward secondary transfer roller 50. The toner image formed on the intermediary transfer belt 40 as described above is transferred (secondary transfer) onto a sheet P of recording medium by the function of the outward secondary transfer roller 50, in the secondary transferring portion T2 while the sheet P is conveyed by the intermediary transfer belt 40 and outward secondary transfer roller 50, remaining pinched between the intermediary transfer belt 40 and outward secondary transfer roller 50. During the secondary transfer, the secondary transfer voltage (secondary transfer bias) is applied to the outward secondary transfer roller 50 by the secondary transfer power source E. The secondary transfer bias is a DC voltage, and is opposite in polarity from the normal toner charge.

Sheets P of recording medium (paper, transparent film, or the like) are stored in layers in a cassette 10. They are fed one by one into the main assembly of the image forming apparatus 100 by a feed roller 11 or the like, and then, are conveyed to a pair of registration rollers 13 by a pair of conveyance rollers 12, or the like. The pair of registration rollers 13 release each sheet P of recording medium with such timing that the sheet P arrives at the secondary transferring portion T2 at the same time as the toner image on the intermediary transfer belt 40. There is provided a conveyance guide 17 having top and bottom guides 14 and 15, in the area into which the pair of registration rollers 13 send the sheet P. It is between the top and bottom guides 14 and 15 of the conveyance guide 17 that the sheet P is sent. The functions and positioning of the top and bottom guides 14 and 15 are described later in detail. After the sheet P is conveyed through the secondary transferring portion T2, it is guided by a post-transfer guiding member 16 to a fixing apparatus 60, as a fixing means, which has two rotational members, more specifically, a fixation roller 60*a* and a pressure roller 60*b*, which form a fixing portion T3 (fixation nip) by being placed in contact with each other. The fixation roller 60*a* is heated by a heating member (unshown) such as a heat lamp or the like positioned in the hollow of the fixation roller 60*a*, whereas the pressure roller 60*b* is kept pressed upon the fixation roller 60*a* by a pressing mechanism (unshown). The sheet P is conveyed through the fixing portion T3 while remaining sandwiched between the fixation roller 60*a* and pressure roller 60*b*. While the sheet P is conveyed through the fixing portion T3, the sheet P and the toner image thereon are heated and pressed. Consequently, the toner image is fixed to the sheet P (melted and becomes solidly fixed to sheet P). Thereafter, the sheet P is discharged (outputted) out of the main assembly of the image forming apparatus 100.

The primary transfer residual toner, that is, the toner which failed to be transferred onto the intermediary transfer belt 40 during the primary transfer process, and therefore, remains on the peripheral surface of the photosensitive drum 1 after the primary transfer, is removed from the peripheral surface of the photosensitive drum 1 and recovered by the drum cleaning apparatus 7 as a photosensitive drum cleaning means. More specifically, the drum cleaning apparatus 7 has a cleaning blade which is placed in contact with the peripheral surface of the photosensitive drum 1. It recovers the secondary transfer residual toner by scraping the peripheral surface of the photosensitive drum 1 with its cleaning blade. The cleaning blade is in the form of a piece of plate formed of an elastic substance such as polyurethane. It is positioned so that its scraping (cleaning) edge is on the upstream side of its base in terms of the moving direction of the photosensitive drum 1). Further, the image forming apparatus 100 is provided with a belt cleaning apparatus 44, as an intermediary transferring member cleaning means, which is positioned on the outward side of the outward surface of the intermediary transfer belt 40, in a manner to oppose the tension roller 41. The secondary transfer residual toner, that is, the toner which failed to be transferred onto the sheet P during the secondary transferring process, and therefore, remains on the outward surface of the intermediary transfer belt 40, is removed and recovered from the outward surface of the intermediary transfer belt 40 by the belt cleaning apparatus 44. More concretely, the belt cleaning apparatus 44 has a cleaning blade placed in contact with the outward surface of the intermediary transfer belt 40. It recovers the secondary transfer residual toner and the contaminants such as paper dust having adhered to the outward surface of the intermediary transfer belt 40, by rubbing (scraping) the outward surface of the intermediary transfer belt 40 with the cleaning blade. The cleaning blade also is formed of an elastic substance such as polyurethane or the like, and is in the form of a piece of plate, like the cleaning blade of the drum cleaning apparatus 7. It is positioned in contact with the outward surface of the intermediary transfer belt 40 in such a manner that its cleaning edge, by which it is placed in contact with the intermediary transfer belt 40, is on the upstream side of its base portion in terms of the moving direction of the intermediary transfer belt 40.

2. Structural Arrangement for Image Transfer

<Primary Transfer Roller>

The primary transfer roller 6 forms the primary transferring portion T1 between the photosensitive drum 1 and intermediary transfer belt 40, by being pressed upon the intermediary transfer belt 40. In this embodiment, the primary transfer roller 6 is kept pressed upon the portion of the intermediary transfer belt 40, which is backed up by the photosensitive drum 1, by a total pressure of 1.5 kg, for example. It is rotated by the rotational movement of the intermediary transfer belt 40. In this embodiment, the primary transfer roller 6 is a cylindrical columnar member, and an elastic layer which covers the entirety of the peripheral surface of the cylindrical member. The cylindrical columnar member is formed of an electrically conductive substance, and is 8 mm in diameter. The elastic layer is formed of an electrically conductive foamed substance. It is $5.0\times10^6$ in electrical resistance, and is 1.0 mm in thickness. Also in this embodiment, the primary transfer roller 6 is positioned so that the vertical straight line which coincides with the rotational axis of the primary transfer roller 6 is on the upstream side of the vertical straight line which coincides with the rotational axis of the photosensitive drum 1, in terms of the rotational direction of the intermediary transfer belt 40. By the way, the vertical straight line which coincides with the rotational axis of the primary transfer roller 6 is roughly perpendicular to the surface of the intermediary transfer belt 40. Further, the vertical straight line which coincides with the rotational axis of the photosensitive drum 1 is roughly perpendicular to the surface of the intermediary transfer belt 40. In this embodiment, the distance between these two vertical straight lines is 2.5 mm.

<Intermediary Transfer Belt>

The intermediary transfer belt 40 is an image bearing member, which is in the form of an endless belt. It rotates in contact with the photosensitive drum 1. It is an example of intermediary transferring member for conveying the toner image transferred (primary transfer) onto the intermediary transfer belt 40, in order to transfer (secondary transfer) the toner image onto a sheet P of recording medium. It is formed to be endless, of a resinous substance. On the inward side of the loop the intermediary transfer belt 40 forms, multiple suspension-tension rollers, more specifically, the tension roller 41, inward secondary transfer roller 42, and driving roller 43, are positioned in contact with the intermediary transfer belt 40. The intermediary transfer belt 40 is provided with a preset amount of tension by being suspended and tensioned by the tension roller 41, inward secondary transfer roller 42, and driving roller 43. In this embodiment, the driving roller 43, or one of the aforementioned three suspension-tension rollers, is positioned on the upstream side of the inward secondary transfer roller 42, in terms of the rotational direction of the intermediary transfer belt 40, being next to the inward secondary transfer roller 42. It supports and suspends the intermediary transfer belt 40, between itself and the inward secondary transfer roller 42. Further, the driving roller 43, or one of the aforementioned three suspension-tension rollers, suspends and tensions the intermediary transfer belt 40, between itself and the tension roller 41 positioned on the upstream side of the driving roller 43 in terms of the rotational direction of the intermediary transfer belt 40, and in the adjacencies of the driving roller 43. By the way, the back surface of the intermediary transfer belt 40 is the opposite surface of the intermediary transfer belt 40 from the surface of the intermediary transfer belt 40, on which a toner image is borne, that is, the inward surface of the intermediary transfer belt 40 with reference to the loop the intermediary transfer belt 40 forms. Further, the outward surface of the intermediary transfer belt 40 means the surface of the intermediary transfer belt 40, which bears the toner image, that is, the outward surface of the intermediary transfer belt 40 with reference to the loop the intermediary transfer belt 40 forms.

The intermediary transfer belt 40 is a mono- or multi-layer belt. It is formed of a resinous substance. It is desired to be no less than 40 μm in thickness, no less than 1.0 GPa in Young's modulus, and $1.0\times10^{9}$-$1.0\times10^{13}$ in surface resistivity. In this embodiment, a polyimide film, which is 85 μm in thickness, is used as the substrative layer for the intermediary transfer belt 40. It was adjusted in electrical resistance ($1.0\times10^{11}$ Ω/□ in surface resistivity, $1.0\times10^{9}$ Ω·cm in volume resistivity) by mixing carbon black into the base material. However, this embodiment is not intended to limit the present invention in scope. For example, any endless belt, which is $1.0\times10^{9}$-$1.0\times10^{14}$ Ω/□ in surface resistivity, and $1.0\times10^{7}$-$1.0\times10^{12}$ Ω·cm in volume resistivity can be used as the intermediary transfer belt 40.

<Suspension-tension Rollers and Outward Secondary Transfer Roller>

In this embodiment, the driving roller 43 is a rubber roller made up of a metallic core, and an electrically conductive rubber layer, as the surface layer, which covers the peripheral surface of the metallic core. The metallic core of the driving roller 43 is grounded (connected to ground). It is an example of upstream roller positioned on downstream side of the image forming portion T1 (primary transferring portion) and on the upstream side of the inward secondary transfer roller 42.

Further, in this embodiment, the tension roller 41 is a metallic roller. It is positioned on the inward side of the loop the intermediary transfer belt 40 forms. It is kept pressed outward of the intermediary transfer belt 40 by a pair of tension springs (unshown), which are elastic members as pressure applying means, at its lengthwise ends in terms of the direction parallel to its rotational axis.

Also in this embodiment, the inward secondary transfer roller 42 is a solid roller, the surface layer of which is an electrically conductive rubber layer. The external diameter of the inward secondary transfer roller 42 is 20 mm, for example.

Further, in this embodiment, the outward secondary transfer roller 50 is a sponge roller. It has a metallic core (stainless steel core) and a surface layer (sponge layer) formed of an electrically conductive sponge in a manner to cover the peripheral surface of the metallic core. The external diameter of the outward secondary transfer roller 50 is 24 mm, for example. In terms of the rotational direction of the intermediary transfer belt 40, the outward secondary transfer roller 50 is positioned on the upstream side of the inward secondary transfer roller 42, by 3 mm, for example. Further, the inward secondary transfer roller 42 is kept pressed toward the inward secondary transfer roller 42, being therefore roughly perpendicularly pressed upon the surface of the intermediary transfer belt 40, by a pair of springs (unshown) which are elastic members as pressure applying means, at its ends in terms of the direction parallel to the rotational axis of the outward secondary transfer roller 50. By the way, the outward secondary transfer roller 50 is pressed against the inward secondary transfer roller 42 with the presence of the intermediary transfer belt 40 between the two secondary transfer rollers 42 and 50. By disposing the outward secondary transfer roller 50 on the upstream side of the inward secondary transfer roller 42, it is possible to improve an image forming apparatus in the adhesion between a sheet P of recording medium and intermediary transfer belt 40, on the upstream side of the secondary transferring portion T2, and also, in transfer performance.

In this embodiment, the electric field for transferring a toner image from the intermediary transfer belt 40 onto a sheet P of recording medium, in the secondary transferring portion T2, is formed by a combination of the inward secondary transfer roller 42 and outward secondary transfer roller 50. Also in this embodiment, the secondary transfer bias, which is opposite in polarity from the normal toner charge, is applied to the outward secondary transfer roller 50. The inward secondary transfer roller 42 is grounded. However, the secondary transfer bias, which is the same in polarity as the normal toner charge, may be applied to the inward secondary transfer roller 42, while the outward secondary transfer roller 50 is grounded.

In this embodiment, the driving roller 43, tension roller 41, and inward secondary transfer roller 42, by which the intermediary transfer belt 40 is suspended and tensioned, are positioned so that the directions parallel to their rotational axes, one for one, are roughly parallel to each other. Moreover, the directions parallel to the rotational axes of the suspension-tension rollers 41, 42 and 43, outward secondary transfer roller 50, and the pressure roller 25 (which will be described later), one for one, are also parallel to each other.

By the way, in this embodiment, the driving roller 43 is the upstream roller positioned on the upstream side of the inward secondary transfer roller 42, and on the downstream side of the image forming portion S, in terms of the rotational direction of the intermediary transfer belt 40. However, the image forming apparatus 100 may be structured so that the tension roller 41 is the upstream roller. In such a case, the image forming apparatus 100 has only to be structured so that the driving roller 43 is positioned in the position in which the tension roller 41 is in this embodiment.

3. Pressing Member

Figure 2:
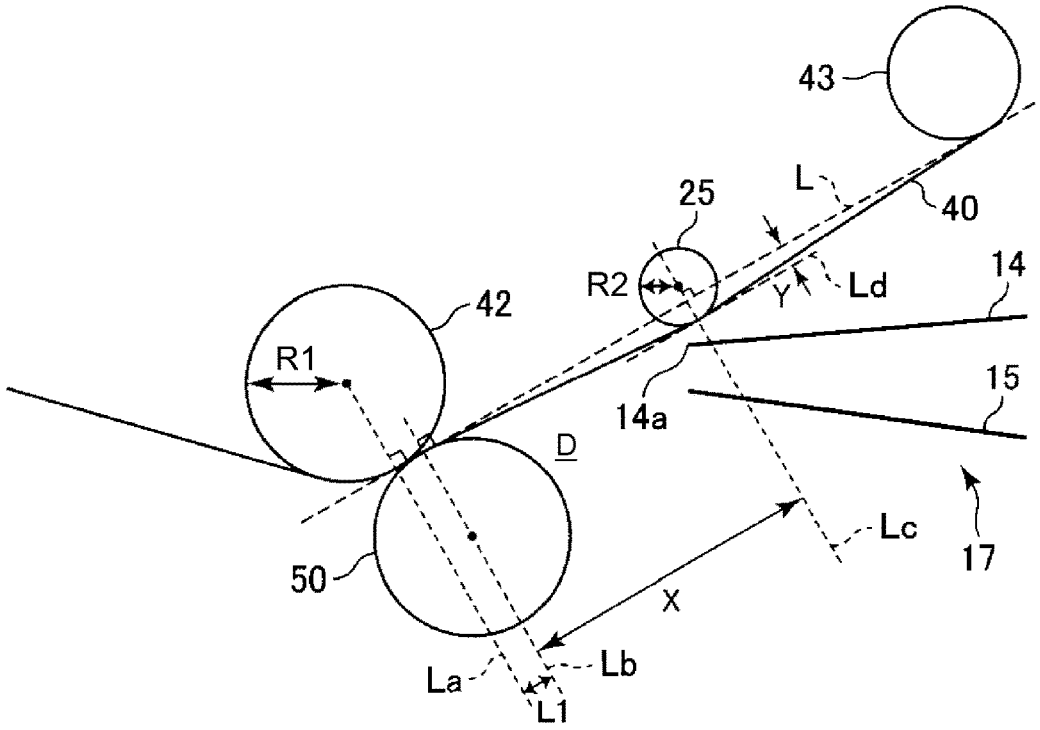
FIG. 2 is a schematic vertical sectional view of the secondary transferring portion and its adjacencies of the image forming apparatus in the first embodiment.

FIG. 2 is a schematic vertical sectional view (roughly perpendicular to the rotational axis of inward secondary transfer roller 42) of the secondary transferring portion T2 and its adjacencies in this embodiment. The image forming apparatus 100 in this embodiment is provided with the pressure roller 25, as a pressing member (vibration prevention member), which is for pressing the portion of the intermediary transfer belt 40, which is between the inward secondary transfer roller 42 and driving roller 43, from the inward surface side of the intermediary transfer belt 40 to slightly displace this portion of the intermediary transfer belt 40 toward the outward surface side of the intermediary transfer belt 40. The pressure roller 25 is positioned on the upstream side of the inward secondary transfer roller 42, and on the downstream side of the driving roller 43, in terms of the rotational direction of the intermediary transfer belt 40, to press the intermediary transfer belt 40 outward from the inward surface side of the intermediary transfer belt 40. In terms of the rotational direction of the intermediary transfer belt 40, the pressure roller 25 is positioned in the upstream adjacencies of the inward secondary transfer roller 42, and also, in the downstream adjacencies of the driving roller 43. In particular, in this embodiment, the pressure roller 25 is positioned so that its presses the intermediary transfer belt 40 at a point which is on the upstream side of the area (secondary transferring portion T2) of contact between the intermediary transfer belt 40 and inward secondary transfer roller 42, and which is no more than 25 mm from the area of contact (secondary transferring portion T2). By positioning the pressure roller 25 so that the pressure roller 25 presses the intermediary transfer belt 40 at the point which is on the upstream side of the inward secondary transfer roller 42 and is no more than 25 mm from the inward secondary transfer roller 42, it is possible to obtain the effect of preventing the intermediary transfer belt 40 from undulating and/or vibrating.

The pressure roller 25 is rotatably supported by a transfer unit frame (unshown), for example, to which the suspension-tension rollers 41, 42 and 43 for suspending and tensioning the intermediary transfer belt 40 are supported, a frame (unshown) of the main assembly of the image forming apparatus 100, or the like. In this embodiment, the pressure roller 25 is a roller (metallic roller) formed of SUS. By the way, in this embodiment, the pressure roller 25 is grounded by way of a resistive member (varistor or the like), preventing thereby the problem that when the secondary transfer voltage is applied to the outward secondary transfer roller 50, current flows into the pressure roller 25. The length of the pressure roller 25 in terms of the direction parallel to its axial line is roughly the same as the dimension (width) of the intermediary transfer belt 40 in terms of the direction perpendicular to the rotational direction of the intermediary transfer belt 40. Thus, the pressure roller 25 contacts the intermediary transfer belt 40 across roughly the entire width of the intermediary transfer belt 40. The pressure roller 25 remains in contact with the intermediary transfer belt 40. Thus, as the intermediary transfer belt 40 is rotationally moved, the pressure roller 25 is rotated by the intermediary transfer belt 40.

The pressure roller 25 presses the intermediary transfer belt 40 to displace the portion of the intermediary transfer belt 40, which is between the inward secondary transfer roller 42 and the driving roller 43, outward of the belt loop, in the adjacencies of the secondary transferring portion T2, to prevent the intermediary transfer belt 40 from becoming unstable in attitude, more specifically, from vibrating and/or undulating. The amount by which the abovementioned portion of the intermediary transfer belt 40 is to be displaced is preset, and the pressure roller 25 is positioned in a position which matches the amount Y. That is, here, a straight line, which is perpendicular to the line which connects the center of the inward secondary transfer roller 42 and that of the outward secondary transfer roller 50 and divides the connective line into two halves is referred to as a nip line. Further, of the two areas separated by this nip line, the one which is on the outward secondary transfer roller 50 side is referred to as an area D. In this case, the portion of the intermediary transfer belt 40, which is under the pressure from the pressure roller 25, being therefore protrusive into the outward surface side of the intermediary transfer belt 40, is in this area D. Therefore, in the adjacencies of the secondary transferring portion T2, a sheet P of recording medium is conveyed along the nip line. However, the intermediary transfer belt 40 is below the nip line. Therefore, it presses on the top surface of the sheet P, ensuring that the sheet P is kept desirably adhered to the intermediary transfer belt 40. Therefore, the image forming apparatus 100 in this embodiment is superior in transfer performance to any conventional image forming apparatus.

Referring to FIG. 2, a referential code (letter) L stands for the referential line, more specifically, the line which is tangential to both the inward secondary transfer roller 42 and driving roller 43, by which the intermediary transfer belt 40 is suspended. A referential code Ld stands for the line which is tangential to the belt pressing portion of the pressure roller 25, that is, the line which is tangential to the intermediary transfer belt 40 in the area in which the pressure roller 25 is in contact with the intermediary transfer belt 40. In this case, the amount Y by which the intermediary transfer belt 40 is displaced by the pressure roller 25, is equal to the distance between the referential line L and the line Ld which is tangential to the intermediary transfer belt 40.

The studies made by the inventors of the present invention revealed that in the case of the image forming apparatus 100 in this embodiment, which is structured as described above, it can effectively prevent its intermediary transfer belt 40 from vibrating and/or undulating, as long as the amount Y is no less than 0.5 mm, and no more than 3.5 mm. That is, in the case of the image forming apparatus 100 in this embodiment described above, it is desired to be structured so that an inequality $0.5\ \text{mm} < Y \leq 3.5\ \text{mm}$ is satisfied. If the displacement amount Y is no more than 0.5 mm, it is difficult to prevent the intermediary transfer belt 40 from vibrating and/or undulating, and therefore, it sometimes occurs that the image forming apparatus 100 outputs unsatisfactory images attributable to the abnormal electrical discharge between the intermediary transfer belt 40 and a sheet P of recording medium. On the other hand, if the displacement amount Y is no less than 3.5 mm, the load to which the area of contact (interface) between the pressure roller 25 and intermediary transfer belt 40 is subjected becomes excessive. Therefore, it is likely for the intermediary transfer belt 40 to fail to smoothly rotate.

Further, in order to prevent the problem that a gap is generated between a sheet P of recording medium and intermediary transfer belt 40, the distance X between the outward secondary transfer roller 50 and pressure roller 25 is set in advance, and the pressure roller 25 is positioned in accordance with the abovementioned displacement amount Y and the distance X.

Referring to FIG. 2, a referential code La stands for a straight line which coincides with the rotational axis of the inward secondary transfer roller 42 and is roughly perpendicular to the referential line L. A referential code Lb stands for a straight line which coincides with the rotational axis of the outward secondary transfer roller 50 and is roughly perpendicular to the referential line L. Further, a referential code Lc stands for a straight line which coincides with the point at which the line Ld is tangential to the intermediary transfer belt 40 and is roughly perpendicular to the referential line L. In this embodiment, the line which coincides with the axial line of pressure roller 25 and is roughly perpendicular to the referential line L is the line Lc. Further, the distance between the line which coincides with the axial line of the outward secondary transfer roller 50 and the line Lc which is perpendicular to the area of contact (interface)

between the pressure roller 25 and intermediary transfer belt 40 is the distance X. Further, the distance between the line La which coincides with the axial line of the inward secondary transfer roller 42 and the line Lb which coincides with the axial line of the outward secondary transfer roller 50 is the distance L1 (which, however, takes a negative value if the line Lb which coincides with the rotational axis of the outward secondary transfer roller 50 is on the upstream side of the line La which coincides with the rotational axis of the inward secondary transfer roller 42, in terms of the rotational direction of the intermediary transfer belt 40). This distance L1 is equivalent to the amount (which hereafter may be referred to as displacement amount) by which the outward secondary transfer roller 50 is displaced from the inward secondary transfer roller 42. Further, referential codes R1 and R2 stand for the radius of the inward secondary transfer roller 42 and that of the outward secondary transfer roller 50, respectively.

The studies made by the inventors of the present invention revealed that this embodiment is more effective to prevent the intermediary transfer belt 40 from vibrating and/or undulating if the distance X is greater than $((R1+R2)^2-(R1-R2)^2)^{1/2}-L1)+7$ mm, and smaller than 25 mm, than otherwise. Further, the studies revealed that satisfying this condition is effective to prevent the problem that a gap is generated between a sheet P of recording medium and intermediary transfer belt 40. That is, in the case of the image forming apparatus 100 in this embodiment structured as described above, it is desired that an inequality: $((R1+R2)^2-(R1-R2)^2)^{1/2}-L1)+7<X<25$ mm is satisfied. If the distance X is made excessively small, it sometimes occurs that the pressure roller 25 interferes with the driving of the inward secondary transfer roller 42 and outward secondary transfer roller 50. If the driving of the inward secondary transfer roller 42 and outward secondary transfer roller 50 is interfered, the intermediary transfer belt 40 fails to be smoothly driven. If the primary transferring process and secondary transfer process are carried out while the intermediary transfer belt 40 is failing to be smoothly driven, it sometimes occurs that the toner image fails to be transferred onto the preset position on the sheet P, causing thereby the image forming apparatus 100 to output an unsatisfactory image. On the other hand, if the distance X is greater than 25 mm, this embodiment is less effective to prevent the intermediary transfer belt 40 from vibrating and/or undulating than otherwise. Therefore, it is possible that the image forming apparatus 100 will output an unsatisfactory image attributable to the abnormal electrical discharge between the intermediary transfer belt 40 and the sheet P.

In this embodiment, the radius R1 of the inward secondary transfer roller 42 is 10 mm, and the radius R2 of the pressure roller 25 is 3 mm. Further, the radius of the outward secondary transfer roller 50 is 112 mm, and the amount L1 of belt displacement is 3 mm. Further, $((R1+R2)^2-(R1-R2)^2)^{1/2}-L1=7.9$ mm.

By the way, the desirable range of the abovementioned amount Y of belt displacement was experimentally obtained through the evaluation regarding whether or not the image forming apparatus 100 outputs unsatisfactory images attributable to unsatisfactory transfer, observation of the transfer belt displacement in the adjacencies of the secondary transferring portion T2, and observation of the intermediary transfer belt 40 regarding its stability while the intermediary transfer belt 40 is rotated. This experiment was repeated under various conditions, more specifically, whether or not the pressure roller 25 was present, positioning of the pressure roller 25 (amount Y of belt displacement, distance X), external diameters of the inward secondary transfer roller 42 and outward secondary transfer roller 50, and recording medium type.

4. Conveyance Guide

Next, the structure and positioning of the conveyance guide 17 in this embodiment are described.

The image forming apparatus 100 has the conveyance guide 17 as a guiding means. The conveyance guide 17 guides a sheet P of recording medium while the sheet P is conveyed to the secondary transferring portion T2 by the pair of registration rollers 13 (registration unit) as a conveying means. It has a top guide 14 and a bottom guide 15. The top guide 14 is the first guiding member, and regulates the movement of the sheet P as the sheet P approaches the intermediary transfer belt 40. The bottom guide 15 is the second guiding member, and regulates the movement of the sheet P as the sheet P separates from the intermediary transfer belt 40. The top and bottom guides 14 and 15 are positioned on the outward side (outward surface side) of the loop the intermediary transfer belt 40 forms. They are positioned so that they extend in the recording medium conveyance direction. In terms of the vertical direction, the top guide 14 is positioned on the top side of the bottom guide 15. That is, the top guide 14 is positioned closer to the intermediary transfer belt 40 than the bottom guide 15. Further, the bottom guide 15 is positioned so that it opposes the top guide 14, and is positioned farther from the intermediary transfer belt 40 than the top guide 14. That is, the top guide 14 is positioned between the bottom guide 15 and intermediary transfer belt 40.

In this embodiment, the top and bottom guides 14 and 15 are such members that are in the form of a piece of plate. They extend in the direction (lengthwise direction) which is roughly perpendicular to the direction in which a sheet P of recording medium is conveyed. The length of each of the top and bottom guides 14 and 15 is roughly the same as a sheet P of recording medium on which an image can be formed by the image forming apparatus 100. However, it is not mandatory that each of the top and bottom guides 14 and 15 is made up of a single piece of plate as described above. For example, each guide may be made up of multiple small pieces of plate aligned in the direction which is roughly perpendicular to the direction in which a sheet P of recording medium is conveyed, or may be of such a size that covers only a part of the recording medium passage. Further, in this embodiment, each of the top and bottom guides 14 and 15 is a metallic member in the form of a piece of plate. However, the material for the top guide 14 does not need to be metallic. For example, it may be a resinous substance as long as the substance is capable of providing the top guide 14 with such an amount of rigidity that can prevent the top guide 14 from deforming, in practical terms, while a sheet P of recording medium is conveyed.

Further, referring to FIG. 2, the top guide 14 is positioned so that its edge 14*a* on the secondary transferring portion T2 side (downstream side in terms of the rotational direction of the intermediary transfer belt 40) is on the secondary transferring portion T2 side of the line Lc described above. That is, in terms of the rotational direction of the intermediary transfer belt 40, the downstream edge 14*a* of the top guide 14 is on the downstream side of the line Lc, and on the upstream side of the secondary transferring portion T2. In other words, in terms of the direction which is roughly parallel to the referential line L, the downstream edge 14*a* of the top guide 14 is closer to the rotational axis of the outward secondary transfer roller 50 than the rotational axis of the pressure roller 25.

By the way, in some cases, a sheet of elastic substance is attached to the top guide 14, in order to prevent the problem that as the trailing edge of a sheet of recording medium passes by the top guide 14, it flips toward the intermediary transfer belt 40. In a case where a sheet of elastic substance is attached to the top guide 14, an image forming apparatus is desired to be structured so that, in terms of the recording medium conveyance direction, instead of the downstream edge of a sheet of recording medium, the downstream edge of the top guide 14 is on the downstream side of the vertical line Lc.

By the way, in this embodiment, the bottom guide 15 also is positioned so that its edge on the secondary transferring portion T2 side (downstream edge in terms of the rotational direction of the intermediary transfer belt 40) is on the secondary transferring portion T2 side of the vertical line Lc. That is, in terms of the rotational direction of the intermediary transfer belt 40, the downstream edge of the bottom guide 15 is on the downstream side of the vertical line Lc, and on the upstream side of the secondary transferring portion T2.

Figure 3:
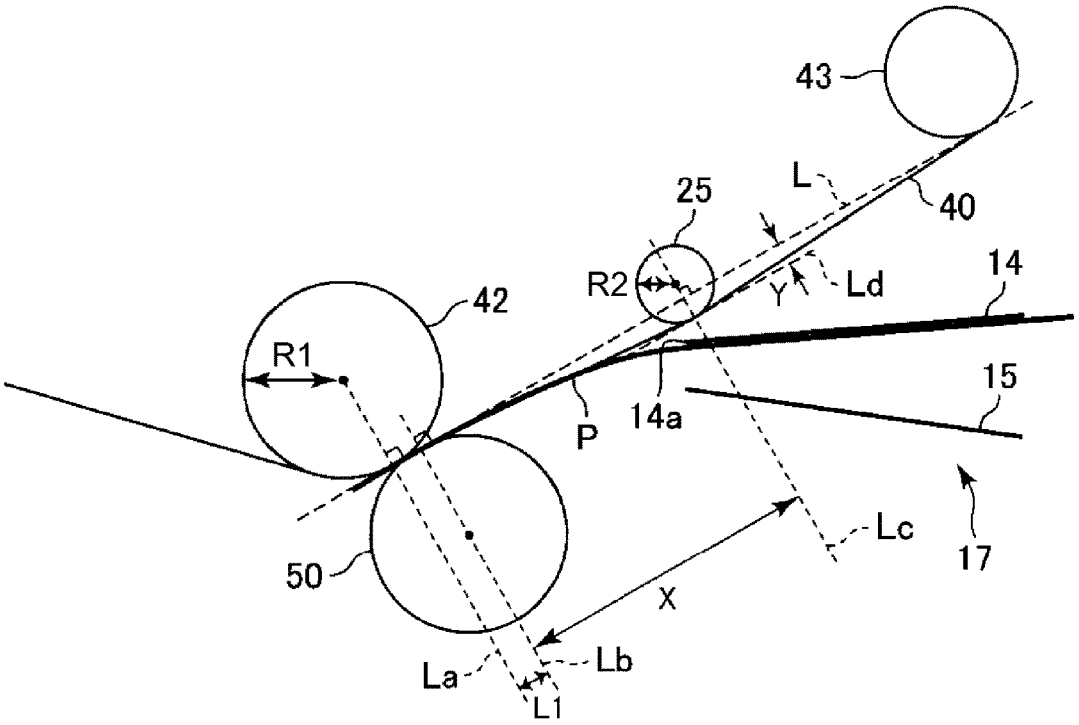
FIG. 3 is a schematic vertical sectional view of the secondary transferring portion and its adjacencies of the image forming apparatus in the first embodiment, and shows the recording medium conveyance passage of the apparatus.

FIG. 3 is a schematic vertical sectional view (at a plane which is roughly perpendicular to the rotational axis of the inward secondary transfer roller 42) of the secondary transferring portion T2 and its adjacencies, in this embodiment. It shows the state of a sheet P of recording medium when the sheet P is being guided by the conveyance guide 17 while it is conveyed to the secondary transferring portion T2. In this embodiment, the downstream edge 14*a* of the top guide 14 is positioned as described above. Therefore, it is possible to prevent the problem that a sheet P of recording medium comes into contact with the intermediary transfer belt 40 across the area in which the pressure roller 25 is pressing the intermediary transfer belt 40.

On the other hand, FIG. 4 is a schematic vertical sectional view (at a plane which is roughly perpendicular to the rotational axis of the inward secondary transfer roller 42) of the secondary transferring portion T2 and its adjacencies in a comparative image forming apparatus. It shows the state of a sheet P of recording medium while the sheet P is guided by the conveyance guide 17 when the sheet P is conveyed to the secondary transferring portion T2. In the case of this comparative image forming apparatus, the top guide 14 is positioned so that its downstream edge 14*a* (in terms of the rotational direction of the intermediary transfer belt 40), that is, the secondary transfer nip T2 side edge of the top guide 14, is placed on the upstream side of the vertical line L in terms of the rotational direction of the intermediary transfer belt 40. In the case of the comparative image forming apparatus, therefore, it occurs sometimes that a sheet P of recording medium comes into contact with the intermediary transfer belt 40 in the area in which the pressure roller 25 is pressing the intermediary transfer belt 40. By the way, the comparative image forming apparatus is the same in structure as the image forming apparatus 100 in this embodiment, except for the portions described above (elements of the comparative image forming apparatus, which are the same as, or correspondent to, the counterparts in this embodiment, in functions or structure, are given the same referential codes as the counterparts in this embodiment).

Figure 5:
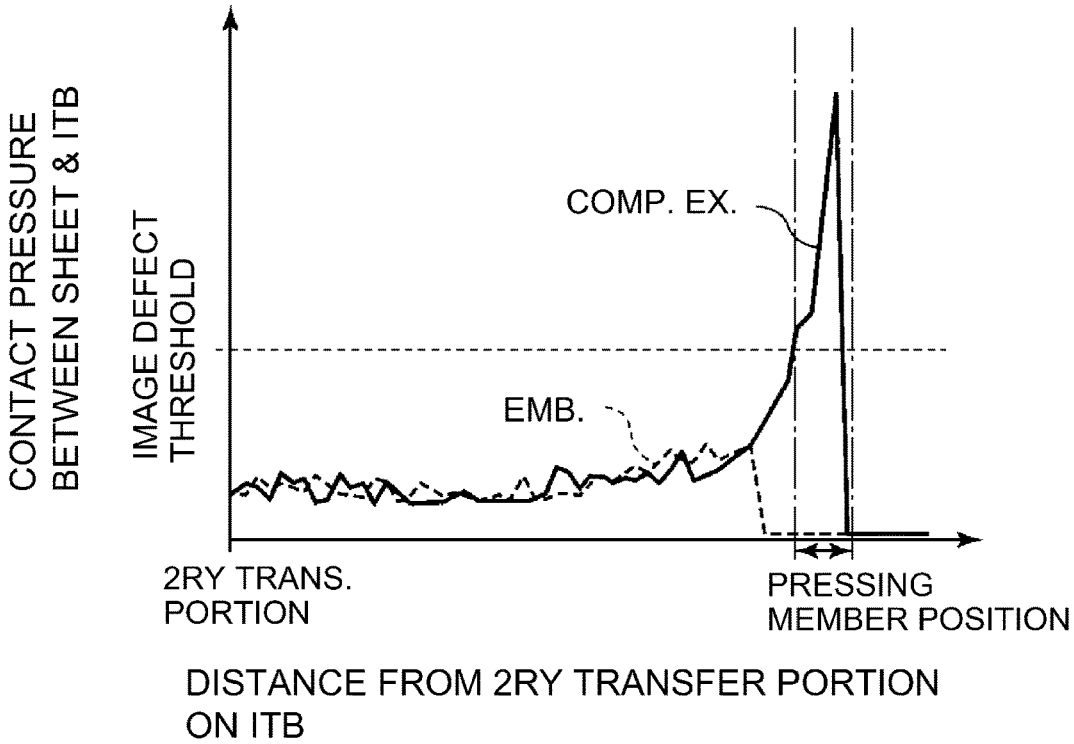
FIG. 5 is a graph which shows the relationship between the distance from the secondary transferring portion to the pressing member, and the contact pressure between a sheet of recording medium and intermediary transfer belt.

FIG. 5 shows the results of the experiment in which the image forming apparatus 100 in this embodiment and the comparative image forming apparatus were compared in contact pressure between a sheet P of recording medium and the intermediary transfer belt 40 between the area in which the pressure roller 25 is pressing the intermediary transfer belt 40 and the secondary transferring portion T2, in terms of the rotational direction of the intermediary transfer belt 40. In this experiment, the contact pressure between the sheet P and intermediary transfer belt 40 was calculated with the use of two-dimensional simulation of paper conveyance. The recording medium was "Mondi Color Copy coated silk, 200 gs, " which is an example of cardstock.

Referring to FIG. 5, in this embodiment, it is prevented that a sheet P of recording medium comes into contact with the intermediary transfer belt 40, in the area in which the pressure roller 25 is pressing the intermediary transfer belt 40. Therefore, it does not occur that the contact pressure between the sheet P and intermediary transfer belt 40 increases in the area in which the pressure roller 25 is pressing the intermediary transfer belt 40. In comparison, in the case of the comparative image forming apparatus, it became evident that as the sheet P came into contact with the intermediary transfer belt 40 in the area in which the pressure roller 25 was pressing the intermediary transfer belt 40, the contact pressure increased. Further, in the case of the comparative image forming apparatus, the sheet P and intermediary transfer belt 40 strongly rubbed against each other, in the area in which the contact pressure increased. Therefore, the unfixed toner image borne on the intermediary transfer belt 40 was disturbed. As a result, the disturbed toner image was transferred onto the sheet P. That is, the comparative image forming apparatus outputted unsatisfactory images.

The phenomenon, described above, that a sheet P of recording medium and intermediary transfer belt 40 rub against each other becomes distinctively conspicuous in the following case. That is, the speed with which a sheet P of recording medium is conveyed is sometimes set faster than the rotational speed of the intermediary transfer belt 40, in order to prevent the problem that the speed with which the sheet P is conveyed is made slower than the rotational speed of the intermediary transfer belt 40 by the friction from the pair of registration rollers 13, changes in the external diameter of the registration rollers 13 attributable to the changes in the environment in which the image forming apparatus 100 is used, and the like. In this case, after the leading edge of the sheet P in terms of the recording medium conveyance direction reaches the secondary transferring portion T2, the sheet P arcs between the secondary transferring portion T2 and the pair of registration rollers 13 while it is conveyed. In the case of the comparative image forming apparatus, therefore, if the sheet P arcs, it is likely to come into contact with the intermediary transfer belt 40 in the area in which the pressure roller 25 is pressing the intermediary transfer belt 40. If the sheet P comes into contact with the intermediary transfer belt 40 in this area, the sheet P and intermediary transfer belt 40 strongly rub each other as described above, disturbing thereby the unfixed toner image borne on the intermediary transfer belt 40. As a result, the disturbed toner image is transferred onto the sheet P. That is, the comparative image forming apparatus is likely to output unsatisfactory images.

In comparison, in the case of the image forming apparatus 100 in this embodiment, even if the pressure roller 25 is positioned on the upstream side of the secondary transferring portion T2 in terms of the rotational direction of the intermediary transfer belt 40, it is prevented that the sheet P and intermediary transfer belt 40 come into contact with each other in the area in which the pressure roller 25 is pressing the intermediary transfer belt 40. Therefore, it prevents the problem that the contact pressure between the sheet P and intermediary transfer belt 40 increases in the area described above. Therefore, it is prevented that the image forming apparatus 100 outputs unsatisfactory images attributable to the phenomenon that the sheet P and intermediary transfer belt 40 rub against each other.

As described above, this embodiment makes it possible to provide an image forming apparatus which is structured to press the intermediary transfer belt 40 from within the loop the intermediary transfer belt 40 forms, in order to improve the apparatus in the secondary transfer performance, and yet, does not output unsatisfactory images attributable to the rubbing between the sheet P and intermediary transfer belt 40.

[Embodiment 2]

Next, another embodiment of the present invention is described. The basic structure and operation of the image forming apparatus in this embodiment are the same as those of the image forming apparatus in the first embodiment. Therefore, the elements of the image forming apparatus in this embodiment, which are the same in function or structure as the counterparts of the image forming apparatus in the first embodiment, are given the same referential codes as those given to the counterparts, and are not described in detail.

1. Pressing Member

Figure 7:
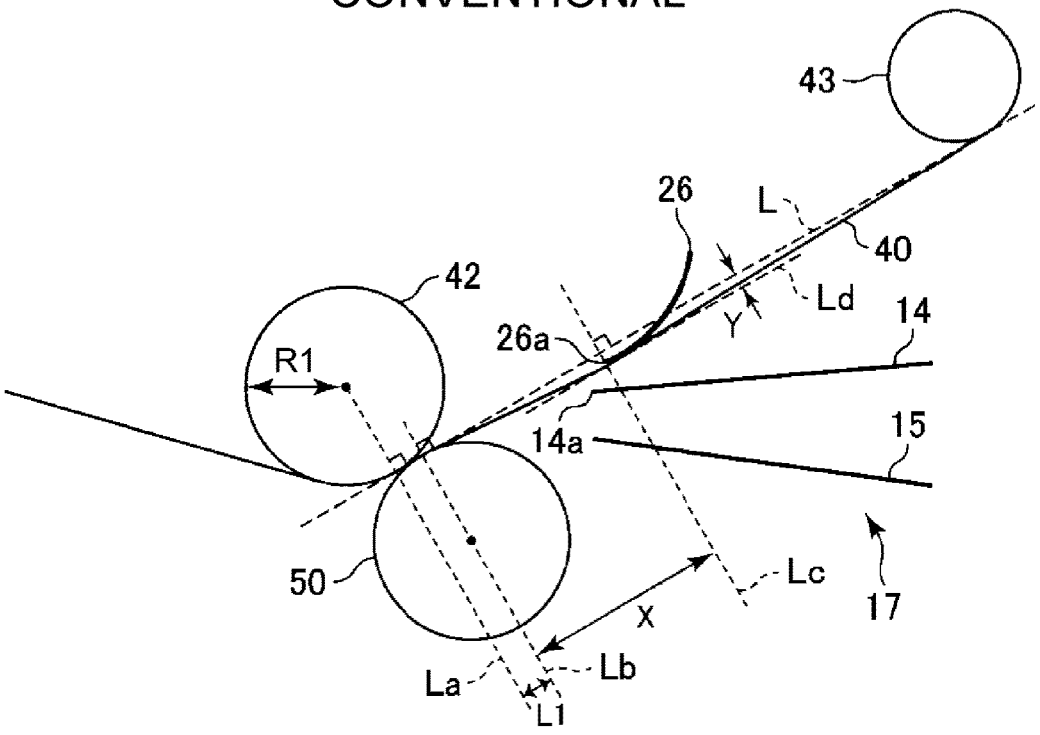
FIG. 7 is a schematic vertical sectional view of the secondary transferring portion and its adjacencies of the image forming apparatus in another embodiment of the present invention.

FIG. 7 is a schematic sectional view (at the plane which is roughly perpendicular to the rotational axis of the inward secondary transfer roller 42) of the secondary transferring portion T2 and its adjacencies of the image forming apparatus in this embodiment. The image forming apparatus 100 in this embodiment has a pressure sheet 26, which is a pressing member in the form of a piece of elastic sheet. The pressure sheet 26 (vibration prevention member) presses the intermediary transfer belt 40 from the back surface side of the intermediary transfer belt 40 in order to displace the portion of the intermediary transfer belt 40 between the outward secondary transfer roller 50 and driving roller 43, outward of the loop the intermediary transfer belt 40 forms. In terms of the rotational direction of the intermediary transfer belt 40, the pressure sheet 26 is positioned on the upstream side of the inward secondary transfer roller 42 and on the downstream side of the driving roller 43. Further, it is positioned so that it presses the intermediary transfer belt 40 outward of the intermediary transfer belt 40 from the inward side of the loop the intermediary transfer belt 40 forms. In particular, it is positioned so that it presses the portion of the intermediary transfer belt 40, which is within no more than 25 mm upstream from the area (secondary transferring portion T2) in which the intermediary transfer belt 40 and inward secondary transfer roller 42 are in contact with each other. By positioning the pressure sheet 26 so that it presses the portion of the intermediary transfer belt 40, which is within no more than 25 mm upstream, it is possible to obtain the effect of preventing the intermediary transfer belt 40 from undulating and/or vibrating.

The pressure sheet 26 is a pressing member in the form of a piece of sheet formed of a resinous substance. As for the desirable substance as the material for the pressure sheet 26, a polyester resin such as PET resin, for example, can be used. In this embodiment, the pressure sheet 26 is given a preset dimension in both its lengthwise direction, which will be roughly perpendicular to the rotational direction of the intermediary transfer belt 40, and its widthwise direction, which is perpendicular to the lengthwise direction. It is given a preset thickness. For example, it is 0.4 mm-0.6 mm in thickness. Further, the dimension of the pressure sheet 26 in terms of its lengthwise direction is 330 mm-380 mm, which is similar to the dimension (width) of the intermediary transfer belt 40 in terms of the direction which is roughly perpendicular to the rotational direction of the intermediary transfer belt 40. The pressure sheet 26 contacts the intermediary transfer belt 40 across roughly the entire width of the intermediary transfer belt 40. It is supported by a transfer unit frame (unshown), that is, the frame to which the suspension-tension rollers 41, 42 and 43, by which the intermediary transfer belt 40 is suspended and tensioned, are attached, or the frame (unshown) of the main assembly of the image forming apparatus 100, for example. The pressure sheet 26 is attached to one of the above mentioned frames, or the like, by its base portion in such an attitude that its free end portion, which is one of the two edge portions which are perpendicular to its widthwise direction, contacts the intermediary transfer belt 40.

For example, in a case where a sheet of PET resin is used as the pressure sheet 26, if the sheet of PET (pressure sheet 26) is low in electrical resistance, electric current flows to the pressure sheet 26 as the secondary transfer voltage is applied to the outward secondary transfer roller 50. Thus, it is possible for a toner image to be unsatisfactorily transferred. On the other hand, if a sheet of PET resin, which is high in electrical resistance is used as the pressure sheet 26, it is possible that static electricity will be generated by the friction between the pressure sheet 26 and intermediary transfer belt 40 (triboelectic charge). Therefore, it is possible that the intermediary transfer belt 40 and pressure sheet 26 will be electrostatically adhered to each other, interfering with the rotation of the intermediary transfer belt 40. Therefore, it is desired that a sheet of PET resin which is to be used as the pressure sheet 26 has been adjusted in electrical resistance (for example, to $1\times10^5$-$1\times10^9$ Ω·cm).

In order to prevent the problem that because the intermediary transfer belt 40 becomes unstable in attitude, more specifically, the problem that the intermediary transfer belt 40 vibrates and/or undulates, in the adjacencies of the secondary transferring portion T2, a sheet P of recording medium and the intermediary transfer belt 40 fail to be desirably adhered to each other, the amount Y by which the intermediary transfer belt 40 is to be displaced is set in advance, and the pressure sheet 26 is positioned in accordance with the amount Y.

Referring to FIG. 7, a referential code L stands for the referential line which is tangential to both the inward secondary transfer roller 42 and driving roller 43, by which the intermediary transfer belt 40 is rotatably suspended. A referential code Ld stands for the line which is roughly parallel to the referential line L and also is tangential to the portion of the intermediary transfer belt 40 which is in the area at which the pressure sheet 26 is in contact with the inward secondary transfer roller 42. In this case, the amount Y, by which the intermediary transfer belt 40 is displaced by the pressure applied thereto by the pressure sheet 26, is equal to the distance between the referential line L and the line Ld.

The studies made by the inventors of the present invention revealed that in the case of the image forming apparatus 100 structured as described above, setting the amount Y to such a value that is no less than 1.0 mm and no more than 3.0 mm is effective to prevent the intermediary transfer belt 40 from vibrating and/or undulating. That is, in the case of the image forming apparatus in this embodiment structured as described above, it is desired that an inequality 1.0 mm≤Y≤3.0 mm is satisfied. If the amount Y is no more than 1.0 mm, it is difficult to prevent the intermediary transfer belt 40 from vibrating and/or undulating, and therefore, it is possible that the image forming apparatus will output unsatisfactory images attributable to the abnormal electrical discharge between a sheet P of recording medium and the intermediary transfer belt 40. On the other hand, if the amount Y is no less than 3.0 mm, the load to which the interface between the pressure sheet 26 and intermediary transfer belt 40 is subjected is substantially greater than the load would be otherwise, making it difficult for the intermediary transfer belt 40 to smoothly rotate.

Further, in order to prevent the occurrence of gaps between a sheet P of recording medium and intermediary transfer belt 40, the distance X between the outward secondary transfer roller 50 and pressure sheet 26 is set in advance, and the pressure sheet 26 is positioned according to the amount Y and distance X.

Referring to FIG. 7, a referential code Lb stands for a line which coincides with the rotational axis of the outward secondary transfer roller 50 and is roughly perpendicular to the referential line L. A referential code Lc stands for a straight line which coincides with the point of contact between the intermediary transfer belt 40 and line Ld, and is roughly perpendicular to the referential line L. In this embodiment, a straight line which coincides with the most downstream position (upstream edge of the pressure sheet 26) of the interface between the pressure sheet 26 and intermediary transfer belt 40, in terms of the rotational direction of the intermediary transfer belt 40, and is roughly perpendicular to the referential line L, is the line Lc. In this case, the distance between the line Lb and line Lc is the distance X between the outward secondary transfer roller 50 and pressure sheet 26.

The studies made by the inventors of the present invention revealed that in the case of the image forming apparatus 100 in this embodiment structured as described above, setting the distance X to a value which is no less than 3.0 mm and no more than 15 mm is effective not only to prevent the intermediary transfer belt 40 from vibrating and/or undulating, but also, to prevent the occurrence of gaps between a sheet P of recording medium and the intermediary transfer belt 40. That is, in the case of the image forming apparatus in this embodiment structured as described above, it is desired that an inequality: 3 mm≤X≤15 mm is satisfied. If the distance X is excessively reduced, it sometimes occurs that the pressure sheet 26 will interfere with the driving of the inward secondary transfer roller 42 and outward secondary transfer roller 50. On the other hand, if the distance X is greater than 15 mm, the pressure sheet 26 is less effective to prevent the intermediary transfer belt 40 from vibrating and/or undulating, making it possible for the image forming apparatus to output unsatisfactory images attributable to the abnormal electrical discharge between the intermediary transfer belt 40 and sheet P.

By the way, the preferable ranges for the amount Y and distance X were obtained through the evaluation of whether or not transfer defects occurred when images for evaluation were outputted, observation of the displacement of the intermediary transfer belt 40 in the adjacencies of the secondary transferring portion T2, and observation of how stable the intermediary transfer belt 40 remains while it is moving. This experiment was repeated while varying the conditions such as presence or absence of the pressure sheet 26, positioning of the pressure sheet 26 (amount Y, distance X), and recording medium type.

Further, it is desired that the pressure sheet 26 is positioned so that it does not interfere with the rotation of the intermediary transfer belt 40. In this embodiment, therefore, the pressure sheet 26 is placed in contact with the intermediary transfer belt 40 in such an attitude that the free end portion of the pressure sheet 26, or the downstream edge 26*a* of the pressure sheet 26, is on the downstream side of the pressure sheet 26 in terms of the rotational direction of the intermediary transfer belt 40. Further, since the pressure sheet 26 is pressed upon the intermediary transfer belt 40, the pressure sheet 26 slightly flexes. Therefore, the pressure sheet 26 contacts the intermediary transfer belt 40 by a certain width.

2. Conveyance Guide

Referring to FIG. 7, the top guide 14 is positioned so that its second transfer portion T2 side, that is, the downstream edge 14*a* (in terms of the rotational direction of the intermediary transfer belt 40) is on the secondary transferring portion T2 side of the vertical line Lc. In other words, in terms of the direction which is roughly parallel to the referential line L, the distance of the downstream edge 14*a* of the top guide 14 from the rotational axis of the outward secondary transfer roller 50 is shorter than the distance from the downstream edge 26*a* (most downstream position of the interface between of the pressure sheet 26 and intermediary transfer belt 40).

Therefore (for the same reason as the one given in the description of the first embodiment), even if the pressure sheet 26 is positioned upstream of the secondary transferring portion T2, it is prevented that a sheet P of recording medium comes into contact with the intermediary transfer belt 40 in the area in which the pressure sheet 26 is pressing the sheet P. Therefore, it is prevented that the contact pressure between the sheet P and intermediary transfer belt 40 increases. Therefore, it is possible to prevent the image forming apparatus 100 from outputting images suffering from the defects which are attributable to the rubbing between the sheet P and intermediary transfer belt 40.

As described above, this embodiment also can provide effects similar to those which the first embodiment can. Further, in this embodiment, the pressing member is a piece of sheet, which is relatively simple in structure. Therefore, this embodiment is advantageous from the standpoint of structural simplicity, size reduction, and cost reduction.

[Miscellanies]

In the foregoing, the present invention was described with reference to embodiments of the present invention. However, these embodiments are not intended to limit the present invention in scope.

In the embodiments described above, the image bearing member which is in the form of a belt was the intermediary transfer belt 40. However, the present invention can be applied to any image bearing member as long as the image bearing member is an endless belt which conveys a toner image borne by the endless belt in an image forming portion. As for examples of image bearing member, such as the one described above, which is in the form of a belt, a photosensitive belt and an electrostatically recordable dielectric member can be mentioned in addition to the intermediary transfer belt 40 in the preceding embodiments.

The present invention is also applicable to image forming apparatuses which are partially or entirely different in structure from those in the preceding embodiments. That is, the present invention is applicable to any image forming apparatus which employs an image bearing member in the form of an endless belt, regardless of whether it is of the tandem type or single drum type, and regardless of charging method, electrostatic image forming method, developing method, transferring method, and fixing method. In the foregoing, only the main portion of the image forming apparatus which is related to the formation and transfer of a toner image was described. However, the present invention is also applicable to various image forming apparatuses other than those described above. That is, the present invention is also applicable to various printing machines, copying machines, facsimile machines, and multifunction machines, which are combinations of the above-described main portions, and devices, equipment, casings, etc.

The present invention can provide an image forming apparatus which is structured to press the inward surface of its image bearing belt, for the improvement of its transfer performance, and yet, can prevent a sheet of recording medium and the pressed portion of the belt from rubbing each other, and therefore, can prevent the occurrence of the image defects which are attributable to the rubbing between a sheet of recording medium and its belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-212278 filed on Nov. 1, 2017, which is hereby incorporated by reference herein in its entirety.

What is claimed is:

1. An image forming apparatus comprising:

an image bearing member configured to bear a toner image;

an endless belt provided opposed to said image bearing member and configured to receive the toner image from said image bearing member at a primary transfer portion;

an outer roller contacted to an outer peripheral surface of said belt and configured to transfer the toner image from said belt onto a recording material at a secondary transfer portion;

a plurality of stretching rollers configured to support said belt, said stretching rollers including an inner roller provided opposed to said outer roller with said belt interposed therebetween and cooperative with said outer roller to provide the secondary transfer portion, and an upstream roller provided downstream of the primary transfer portion and upstream of said inner roller, with respect to a moving direction of said belt;

a pressing member provided at a position upstream of said inner roller and downstream of said upstream roller with respect to the moving direction and configured to press said belt in a direction from an inside toward an outside of said belt, said pressing member pressing said belt in a range of 25 mm from a portion where said inner roller contacts said belt toward an upstream side with respect to the moving direction;

a feeding device configured to feed the recording material to the secondary transfer portion; and a guiding member provided downstream of said feeding device and upstream of said secondary transfer portion with respect to a feeding direction of the recording material and configured to regulate movement of the recording material approaching said belt, wherein in a cross-section perpendicular to a rotational axis of said inner roller, a downstream free end of said guiding member is disposed downstream of a pressing portion normal line Lc with respect to the feeding direction of the recording material, where L is a reference line which is a common tangent of said inner roller and said upstream roller in a contact portion relative to said belt, Ld is a pressing portion tangent line, parallel with the reference line, of said belt in a region where said pressing member contacts said belt, and Lc is the pressing portion normal line passing through a contact point between said belt and the pressing portion tangent line Ld and perpendicular to the reference line L.

2. An apparatus according to claim 1, wherein said pressing member presses said belt such that a portion of the belt extending between said inner roller and said pressing member is disposed on a side where said outer roller is disposed, with respect to a nip line which is a perpendicular bisector of a line segment between a rotational center of said outer roller and a rotational center of said inner roller.

3. An apparatus according to claim 1, wherein said pressing member is in the form of a roller.

4. An apparatus according to claim 3, wherein in a cross-section perpendicular to a rotational axis of said inner roller, said pressing member satisfies:

$$(((R1+R2)^2-(R1-R2)^2))^{1/2}-L1)+7\text{ mm}<X<25\text{ mm},$$

and $$0.5\text{ mm}<Y\leq 3.5\text{ mm},$$

where

La is an inner roller center line passing through a rotational center of said inner roller and perpendicular to the reference line L, Lb is an outer roller center line passing through the rotational center of said outer roller and perpendicular to the reference line L, the pressing portion normal line Lc passes through a rotational center of said pressing member and is perpendicular to the reference line L, L1 is a distance between a center line La of said inner roller and a center line Lb of said outer roller (it is positive when the center line Lb of said outer roller is at an upstream side of the center line La of said inner roller with respect to the moving direction of said belt), X is a distance between the center line Lb of said outer roller and the pressing portion normal line Lc, Y is a distance between the reference line L and the pressing portion tangent line Ld, R1 is a radius of said inner roller, and R2 is a radius of said pressing member.

5. An apparatus according to claim 4, wherein L1>0 is satisfied.

6. An apparatus according to claim 1, wherein said pressing member is in the form of a sheet.

7. An apparatus according to claim 6, wherein in a cross-section perpendicular to a rotational axis of said inner roller, said pressing member satisfies:

$$3\text{ mm}\leq X\leq 15\text{ mm, and}$$

$$1.0\text{ mm}\leq Y\leq 3.0\text{ mm},$$

where

Lb is an outer roller center line passing through the rotational center of said outer roller and perpendicular to the reference line L, the pressing portion normal line Lc is perpendicular to the reference line L and passes through a downstreammost position of a contact region between said pressing member and said belt with respect to the moving direction of said belt, X is a distance between the center line Lb of said outer roller and the pressing portion normal line Lc, and Y is a distance between the reference line L and the pressing portion tangent line Ld.

8. An apparatus according to claim 6, wherein said pressing member has predetermined dimensions in a longitudinal direction in parallel with a direction perpendicular to the moving direction of said belt and in a short-side direction perpendicular to the longitudinal direction, and wherein a free end portion, which is one of ends in the short-side direction, faces toward a downstream side with respect to the moving direction of said belt.

9. An apparatus according to claim 1, wherein said guiding member is made of metal.

10. An apparatus according to claim 1, further comprising a sheet provided at a downstream end portion of said guiding member with respect to the feeding direction of the recording material, said sheet being elastically deformable by the recording material which is being fed.

* * * * *